US012575620B2

(12) United States Patent
Plank et al.

(10) Patent No.: US 12,575,620 B2
(45) Date of Patent: Mar. 17, 2026

(54) ONE-PIECE BODYSUIT FOR ATHLETIC ACTIVITIES

(71) Applicant: Under Armour, Inc., Baltimore, MD (US)

(72) Inventors: Kevin Plank, Baltimore, MD (US); Kasey Jarvis, Baltimore, MD (US); Marcus Cheatham, Baltimore, MD (US); Kathleen Su, Baltimore, MD (US); Diaa Abbas, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 6 days.

(21) Appl. No.: 18/518,887

(22) Filed: Nov. 24, 2023

(65) Prior Publication Data

US 2024/0164458 A1 May 23, 2024

Related U.S. Application Data

(60) Provisional application No. 63/427,629, filed on Nov. 23, 2022.

(51) Int. Cl.
*A41D 13/00* (2006.01)
*A41D 13/015* (2006.01)

(52) U.S. Cl.
CPC ..... *A41D 13/0015* (2013.01); *A41D 13/015* (2013.01); *A41D 2400/38* (2013.01); *A41D 2500/00* (2013.01)

(58) Field of Classification Search
CPC ..... A41D 13/0015; A41D 13/015; A41D 2400/38; A41D 2500/00; A41D 7/00; A41D 2400/44
See application file for complete search history.

(56) References Cited

U.S. PATENT DOCUMENTS

| | | | | |
|---|---|---|---|---|
| 4,179,754 | A | 12/1979 | Denu | |
| 4,999,845 | A | 3/1991 | Jenks, Jr. et al. | |
| 5,060,315 | A * | 10/1991 | Ewing | A41B 9/005 2/400 |
| 5,196,240 | A | 3/1993 | Stockwell | |
| 5,283,908 | A * | 2/1994 | Martin | A41D 13/0017 2/408 |
| 5,630,229 | A | 5/1997 | Machado et al. | |
| 5,768,703 | A | 6/1998 | Machado et al. | |
| 5,896,578 | A | 4/1999 | Hunter et al. | |

(Continued)

FOREIGN PATENT DOCUMENTS

| | | | |
|---|---|---|---|
| AU | 606208 | B2 | 1/1991 |
| DE | 202021003090 | U1 | 1/2022 |

(Continued)

*Primary Examiner* — Haley A Smith
(74) *Attorney, Agent, or Firm* — Maginot, Moore & Beck, LLP

(57) ABSTRACT

A one-piece body suit comprises a collar defining a high neck opening and a torso comprised of a four-way stretch fabric. The torso includes a thoracic region, an abdominal region, and a pelvic region. The thoracic region is connected to the collar and defines arm passages. The abdominal region is connected to the thoracic region. The pelvic region is connected to the abdominal region and defines leg passages. An entry opening for the one-piece body suit is positioned in a back of the torso. The entry opening is free of releasable mechanical fasteners.

17 Claims, 12 Drawing Sheets

(56) References Cited

U.S. PATENT DOCUMENTS

| | | | | |
|---|---|---|---|---|
| 7,971,272 | B2 | 7/2011 | Bailey et al. | |
| 8,082,595 | B2 | 12/2011 | Nordstrom | |
| 9,179,712 | B2 | 11/2015 | Jaggernauth | |
| 10,258,093 | B2 | 4/2019 | Smart | |
| 10,463,089 | B2 | 11/2019 | Cheuk et al. | |
| 10,696,364 | B2 | 6/2020 | Harrington et al. | |
| D915,031 | S | 4/2021 | Touidjine-Williams | |
| D918,532 | S | 5/2021 | Touidjine-Williams | |
| D922,731 | S | 6/2021 | Touidjine-Williams | |
| 2010/0024092 | A1 | 2/2010 | Finell | |
| 2017/0238634 | A1* | 8/2017 | Berns | A41F 9/00 |
| 2018/0027896 | A1 | 2/2018 | Stobar | |
| 2019/0159525 | A1 | 5/2019 | Recometa | |
| 2019/0208831 | A1 | 7/2019 | Joshi | |
| 2022/0369729 | A1* | 11/2022 | Marquez | A41D 1/22 |
| 2023/0354926 | A1* | 11/2023 | Young | A41D 13/02 |
| 2025/0017293 | A1* | 1/2025 | Jessen | A41D 13/0017 |

FOREIGN PATENT DOCUMENTS

| | | | |
|---|---|---|---|
| JP | 3150695 | U | 5/2009 |
| WO | 2014066993 | A1 | 5/2014 |

* cited by examiner

ONE-PIECE BODYSUIT FOR ATHLETIC ACTIVITIES

CROSS-REFERENCE TO RELATED APPLICATIONS

This application claims priority from U.S. provisional patent application No. 63/427,629, filed Nov. 23, 2022, the entire contents of which are incorporated herein by reference.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

The present disclosure relates to articles of apparel and particularly to bodysuits for use in athletic activities.

BACKGROUND

One-piece bodysuits are commonly used in athletic activities, including suits used for indoor sporting activities such as swimming, gymnastics and wrestling, as well as various undergarments used in any number of different outdoor sporting activities that may occur in cold weather such as football, hunting, bicycling, fishing, golf, etc. These one-piece bodysuits prevent separation of upper and lower portions of a suit and avoid the need for bunching and tucking of one garment portion under another. One-piece body suits are typically tight-fitting and formed from a stretch fabric material. These body suits often include a high neckline (e.g., a crew neck or mock neck) and a faster system (e.g., a zipper or buttons) that facilitates access to the garment through an entry opening that at least partially includes the neckline. The fastener system specifically allows the user to control the size of an entry opening in order to assist the user when stepping into or out-from the garment. Unfortunately, the fastener system tends to reduce the amount of stretch offered by the fabric around the body of the wearer. Additionally, the fastener system is often inconvenient to adjust when donning the garment, and may be uncomfortable for the user because the fasteners tend to press into the skin or cut into other garments worn by the user.

In view of the foregoing, it would be advantageous to provide a one-piece bodysuit having a high neck and an entry opening that is convenient to adjust, comfortable to wear, and offers full stretch around the body of the wearer. It would also be advantageous if the bodysuit were relatively easy to manufacture, environmentally friendly, and resulted in reduced overall manufacturing costs.

SUMMARY

In at least one embodiment, a one-piece body suit comprises a collar defining a high neck opening and a torso comprised of a four-way stretch fabric. The torso includes a thoracic region, an abdominal region, and a pelvic region. The thoracic region is connected to the collar and defines arm passages. The abdominal region is connected to the thoracic region. The pelvic region is connected to the abdominal region and defines leg passages. An entry opening for the one-piece body suit is positioned in a back of the torso. The entry opening is free of releasable mechanical fasteners.

In another embodiment, a garment includes a torso comprised of a four-way stretch fabric, wherein the torso is designed and dimensioned to completely cover a torso of an adult human. A collar is connected to the torso and defines a high neck opening centrally positioned on the garment above the torso. An entry opening is positioned at a back of the torso, the entry opening defined between free edges of overlapping panels of the four-way stretch fabric. Two arms extend from an upper side the torso, and two legs extend from a lower side of the torso. Together, the torso, two arms, and two legs form a one-piece body suit.

In yet another embodiment, a garment comprises a plurality of fabric panels connected by stitching and forming a one-piece body suit. Each of the plurality fabric panels are provided by a four-way stretch fabric. A high neck opening is formed at a top of the one-piece body suit. An entry opening is positioned at a back of the one-piece body suit below the high neck opening. The entry opening is free of releasable mechanical fasteners.

The above described features and advantages, as well as others, will become more readily apparent to those of ordinary skill in the art by reference to the following detailed description and accompanying drawings. While it would be desirable to provide a bodysuit that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

Figure 1:
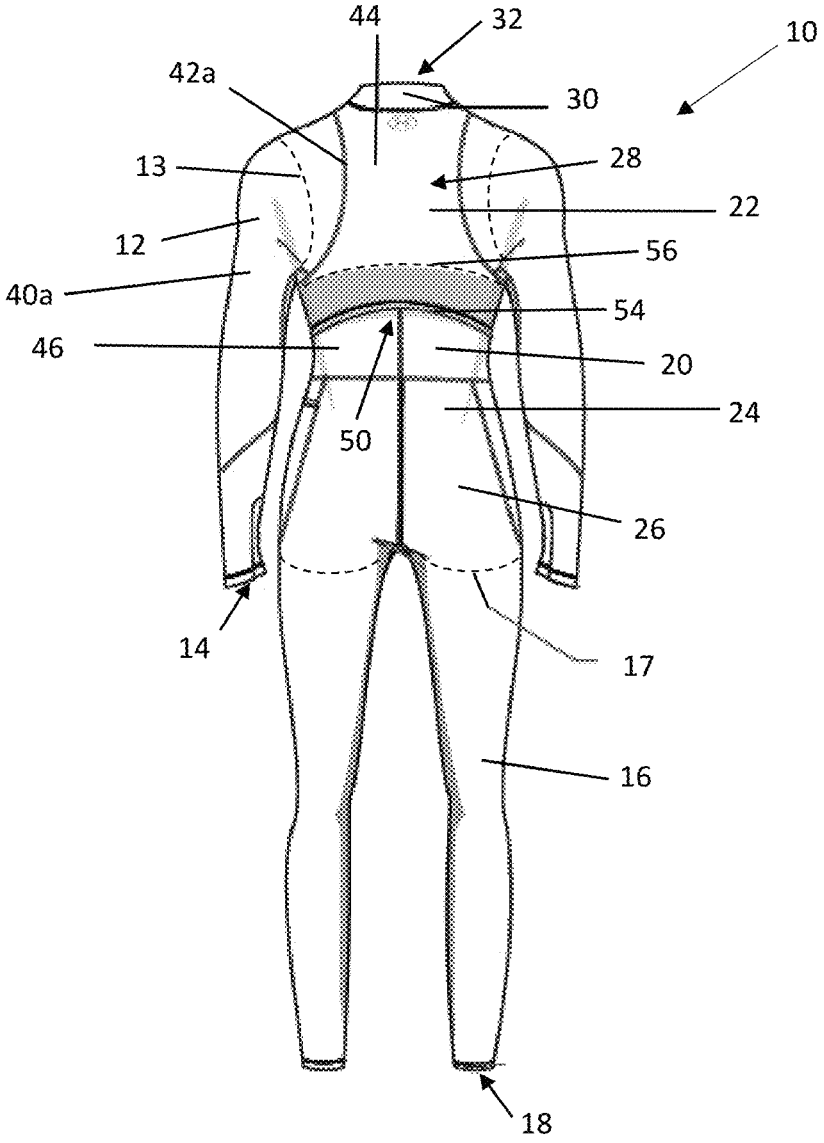
FIG. 1 shows a back view of a one-piece bodysuit having an entry opening positioned on a back portion of the bodysuit, the entry opening defined along a curved edge of an outer panel.
Figure 2:
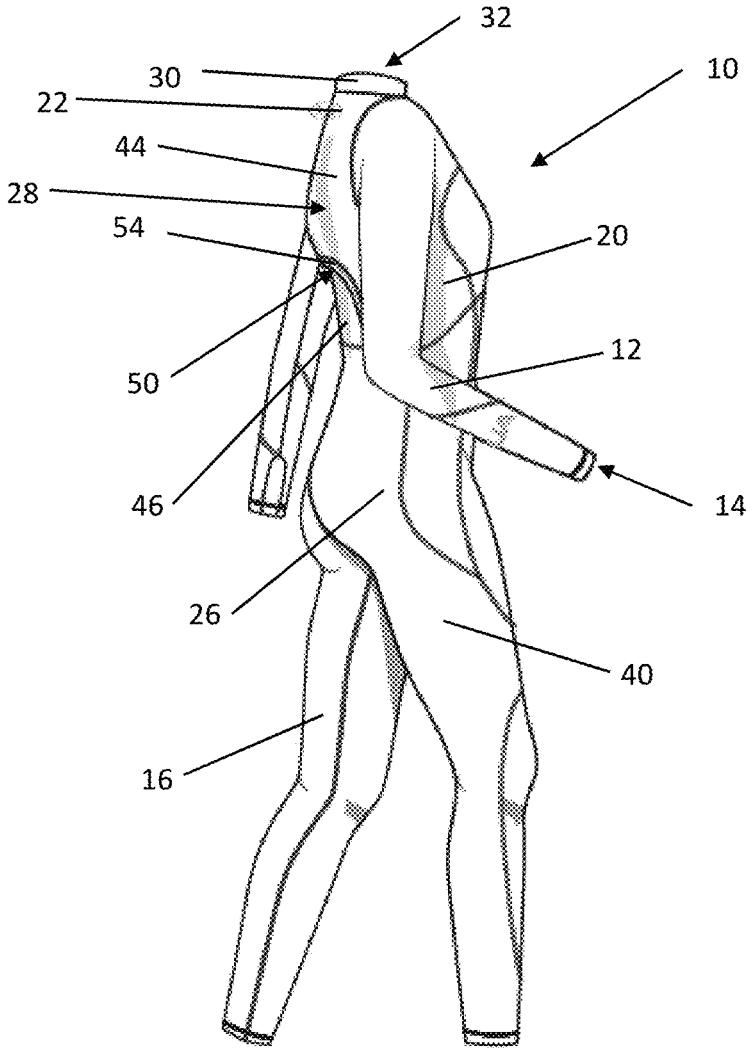
FIG. 2 shows a side view of the bodysuit of FIG. 1.
Figure 3:
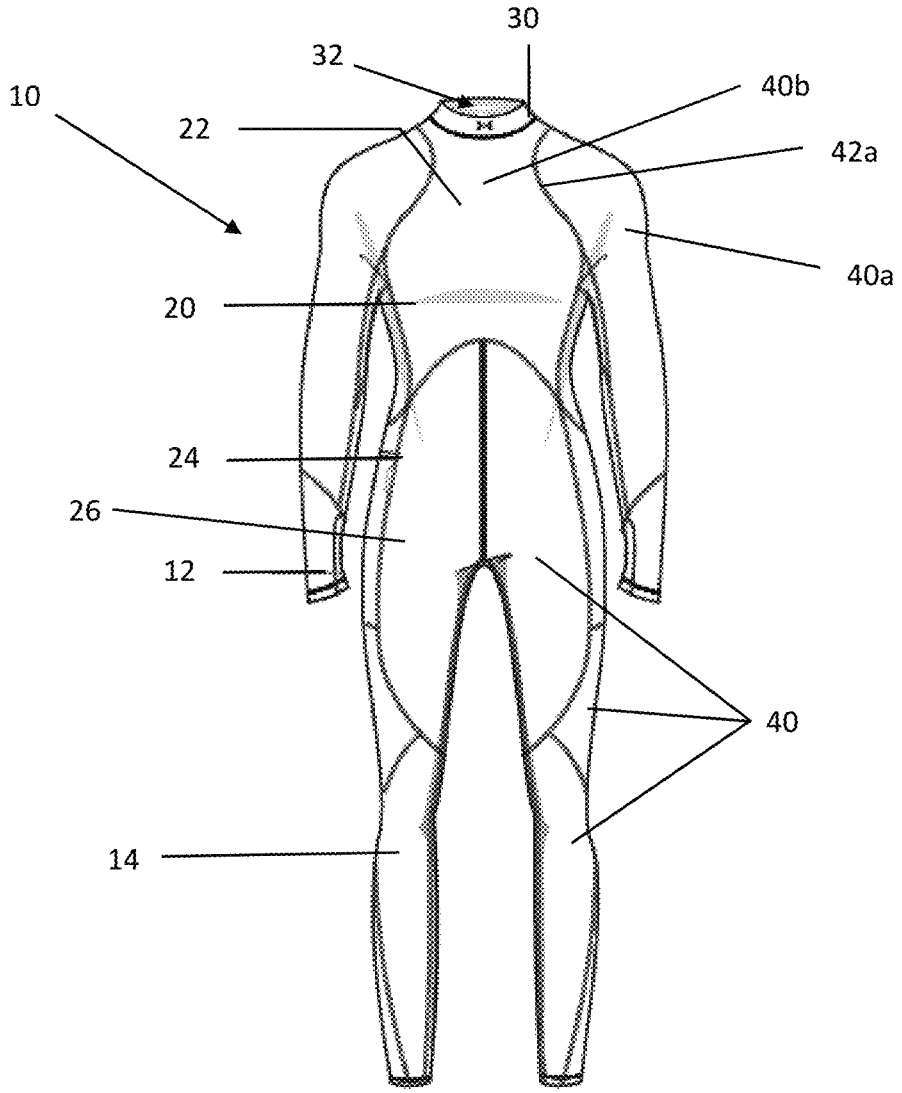
FIG. 3 shows a front view of the bodysuit of FIG. 1.
Figure 4:
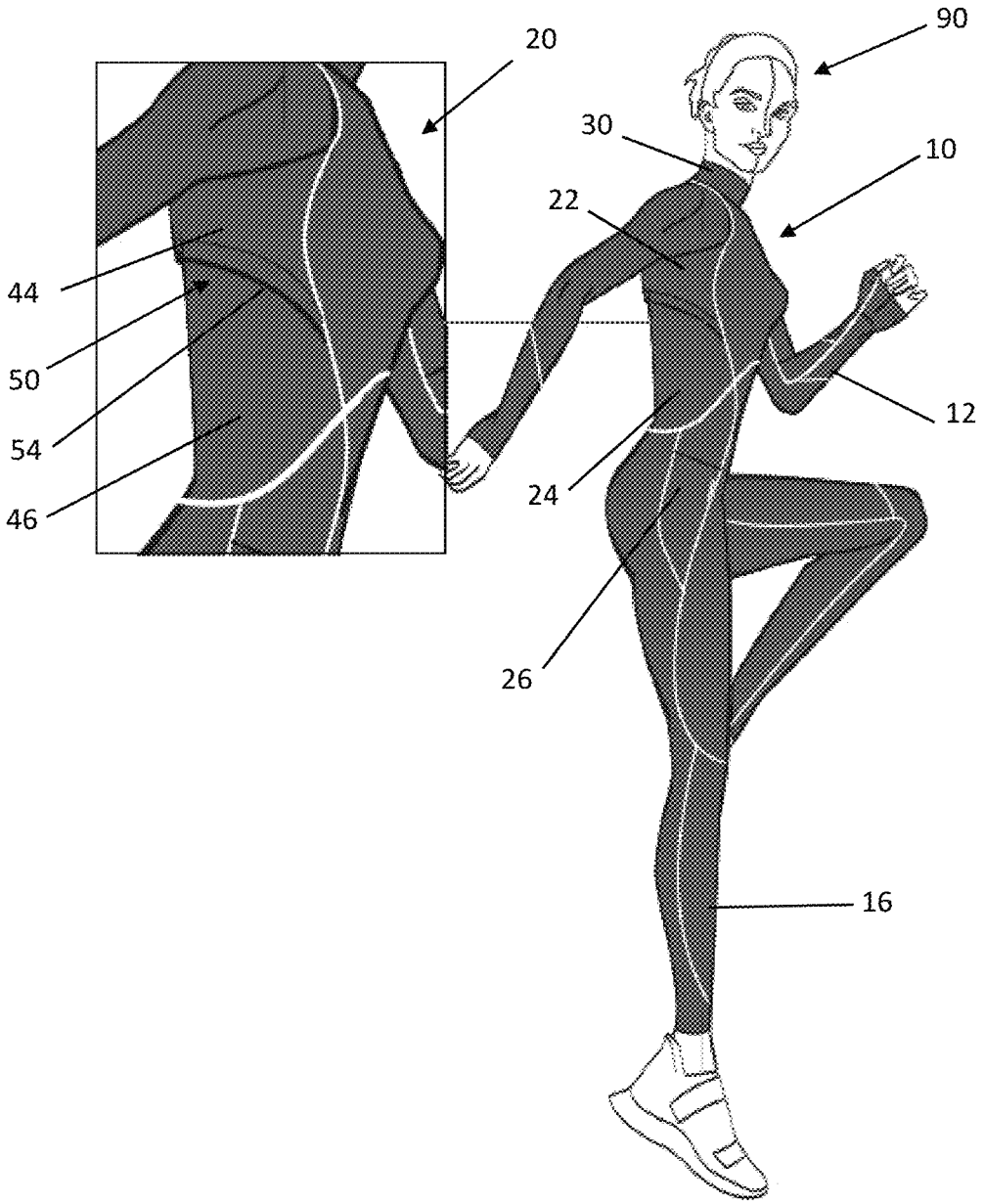
FIG. 4 shows a side view of the bodysuit of FIG. 1 worn by a human.

All Figures ©Under Armour, Inc. 2022. All rights reserved.

DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Overview

As shown in the figures and described in further detail herein, a one-piece body suit is formed from a plurality of fabric panels comprised of a four-way stretch fabric. The one-piece body includes a torso, a collar defining a high neck opening, and an entry opening. The collar and high neck opening are arranged centrally at a top of the torso. The entry opening is arranged on a back of the torso and is free of releasable mechanical fasteners.

First Exemplary Embodiment

With reference now to FIGS. 1-4, a first exemplary embodiment of a garment in the form of a one-piece bodysuit 10 is shown. The one-piece bodysuit 10 (which may also be referred to herein as a "body suit") generally includes two arms 12, two legs 16, a torso 20, and a collar 30. The torso 20 includes a thoracic region 22, an abdominal region 24, and a pelvic region 26. The top of the thoracic region 22 is connected to the collar 30. The bottom of the thoracic region 22 is connected to the top of the abdominal region 24, and the bottom of the abdominal region 24 is connected to the top of the pelvic region 26. The two arms 12 extend from the left and right sides of an upper portion of the thoracic region 22. Arm passages 13 on the interior of the bodysuit 10 provide access to the arms 12 via the thoracic region 22 (which arm passages 13 are noted in dotted lines in FIG. 1 because they are internal within the garment). The two legs 16 extend from the left and right sides of a lower portion of the pelvic region 26. Leg passages 17 on the interior of the bodysuit provide access to the legs 16 via the pelvic region 26 (which leg passages 17 are noted in dotted lines in FIG. 1 because they are internal within the garment).

The body suit 10 is comprised of a plurality of fabric panels 40 that are connected with stitching provided along seam lines 42. The fabric panels 40 are differently configured and extend between different parts and different regions of the body suit 10. For example, a left arm panel 40*a* covers a shoulder of the wearer 90 (see FIG. 4) and extends from below an elbow on one of the arms 12 to the chest and scapula areas within the thoracic region 22. This left arm panel 40*a* is connected to a back and chest panel 40*b* with stitching that extends along seam line 42*a*. Thus, it will be recognized that each of the different fabric panels 40 may extend between different parts and/or regions of the body suit 10 (e.g., from one of the limbs 12, 16 to one or more regions of the torso 20), or may be completely located within one part and/or region of the body suit 10 (e.g., arranged exclusively on one of the limbs 12, 16).

The stitching along the seam lines 42 connects the associated panels of the one-piece body suit 10 in a non-removable manner. In other words, the fabric panels cannot be separated from one another without destruction of the garment (i.e., such that additional stitching would be required to re-form the garment). Thus, the term "one-piece" as used herein refers to a singular garment that is not separable into different components/panels without destruction of the garment.

Each fabric panel 40 is comprised of a four-way stretch material, such as spandex, elastane, or Hytrel® fabric. The four-way stretch fabric is a textile including elastomeric threads that facilitate elastic stretching and contraction of the fabric along two orthogonal axes (e.g., both cross-wise and lengthwise). The four-way stretch material provides the one-piece body suit with stretch characteristics that encircle the wearer 90 and result in a close-fitting comfortable fit. In some embodiments, the fabric is configured to retain heat generated by the wearer. In such embodiments, a fleece lining may be adhered to or otherwise provided on the inner surface of the four-way stretch material to provide additional warmth and comfort against the skin of the wearer. In other embodiments, the fabric includes evaporative yarns configured to wick sweat and keep the wearer cool. In at least some embodiments, the evaporative yarns possess a special cross section that offers more skin contact to absorb heat, and optionally minerals in the yarn that absorb heat from the skin and transfer it to the surrounding environment. One example of the evaporative yarn is AQUA-X by Hyonsong (Seoul, South Korea).

With continued reference to FIGS. 1-4, the body suit 10 includes a plurality of openings, including two arm openings 14, two leg openings 18, a high neck opening 32 and an entry opening 50. The arm openings 14 are provided at the ends of the arms 12, and allow the hands and/or arms of a wearer to pass therethrough. Similarly, the leg openings 18 are provided at the ends of the legs 16, and allow the hands and/or arms of a wearer to pass therethrough. In at least one embodiment, gloves (not shown) are provided at the ends of the arms 12 in lieu of the arm openings 14 and/or booties (not shown) are provided at the ends of the legs 16 in lieu of leg openings.

The high neck opening 32 is positioned at the top of the collar 30 and provides a passage for the head of the wearer 90. The term "high neck opening" as used herein refers to an opening formed in a garment by a crew neck, mock neck, turtleneck or other neck having a neckline that is situated above the sternum and clavicle of the wearer. While a high neck opening is typically rounded along the entire neckline, it may also include rounded necklines with a small V-shaped indentation or similar cut-out. In the embodiment of FIGS. 1-4, the high neck opening is elastic and designed and dimensioned to pass the head of an adult human wearer and allow the collar 30 to fit closely around the neck of the wearer.

The entry opening 50 is positioned on the torso 20. In the embodiment of FIGS. 1-4, the entry opening 50 is positioned in the thoracic region 22 at the back 28 of the torso 20. The term "entry opening" as used herein refers to an opening formed in a garment that is designed and dimensioned to pass the limbs, torso and head of an adult human body in order to allow the human to don the garment. Thus, the entry opening 50 provides the entry point for the wearer when donning the one-piece body suit 10.

In the embodiment of FIGS. 1-4, the entry opening 50 is defined between the free edges of two overlapping panels of the four-way stretch fabric. The term "free edge" as used herein refers to an edge portion of a fabric panel that is not permanently attached to another fabric panel (e.g., via stitching or adhesives) and does not include and is not associated with releasable mechanical fasteners (e.g., no buttons, zippers, snaps, hook-and-loop fasteners, etc.) that are configured to repeatedly attach and detach one panel to another panel along the edge.

The two overlapping panels in the embodiment of FIGS. 1-4 include an upper back panel 44 and a lower back panel 46. The two panels 44, 46 overlap one another by at least two inches, and in some embodiments twelve to eighteen inches. In the embodiment of FIGS. 1-4, the two panels overlap by about five inches (i.e., 4.5 to 5.5 inches) on the back of the body suit 10. The overlapping portion of the two panels 44, 46 is shown in shading in FIG. 1. An exterior free edge 54 is provided by the upper back panel 44, and an interior free edge 56 is provided by the lower back panel 46. The upper back panel 44 may be pulled away from the lower back panel 46 to expose the entry opening 50. Because of the overlap between the two panels 44, 46, the entry may be considered a closed passage wherein the opening associated with the passage is not immediately visible (i.e., the opening is not exposed until the two free edges 54, 56 of the overlapping panels 44, 46 are pulled apart from one another).

The exterior free edge 54 and the interior free edge 56 are arranged such that the entry opening 50 extends horizontally across the back 28 of the torso 20 (i.e., the edges 54 and 56 extend across a length having a significantly greater horizontal component than vertical component). The width of the entry opening 50 is such that it is slightly less than the shoulder width of the intended wearer 90. The vertical placement of the entry opening 50 is such that the overlapping portion of the two panels 44, 46 extends across a lower tip of the shoulder blades when the body suit 10 is donned by the wearer. For example, depending on the size of the garment, the overlapping portion of the two panels 44, 46 may be positioned in the thoracic region of the garment between six and eighteen inches below the collar 30 (e.g., between the T1 and T12 vertebrae of the wearer, and particularly between the T4 and T10 vertebrae). However, it will be recognized that in other embodiments, the entry opening 50 may be positioned at a different vertical position on the back 28 of the torso 20. Moreover, in at least some embodiments, the exterior free edge 54 and interior free edge 56 may be arranged vertically on overlapping panels such that the entry opening 50 extends vertically across the back 28 or front of the torso 20. In other embodiments, the entry opening may be positioned elsewhere on the torso 20, such as on the front of the torso.

With continued reference to the embodiment of FIGS. 1-4, the exterior free edge 54 of the entry opening 50 is a curved concave edge defined by left and right lateral sides (i.e., opposing ends of the free edge 54) that are positioned lower on the back 28, and a center vertex that is positioned higher on the back than the left and right lateral sides. For example, in at least one embodiment, the center vertex may be positioned between one and four inches above the left and right lateral sides. The left and right sides of the exterior free edge 54 begin at seams that extend vertically along the sides of the garment. The curvature of the exterior free edge 54 is defined by a radius of curvature. In at least one embodiment, the radius of curvature is defined by a distance between the exterior free edge 54 and the perineum of the garment (i.e., a circle that extends along the exterior free edge 54 and has a center near the perineum of the garment). This radius depends on the size of the garment, but may be, for example, between twelve an eighteen inches in length. However, it will be recognized that in other embodiments, the exterior free edge 54 may be differently curved or may be a straight edge that is free of curvature.

The interior free edge 56 of the entry opening 50 may be similarly curved to match the curvature of the exterior free edge 54. Accordingly, the interior free edge 56 may be a convex edge having a complementary curvature to that of the exterior free edge 54 such that the distance between the edges 54 and 56 is relatively consistent along the length of the entry opening 50. In other embodiments, the interior free edge 56 may be a straight edge, regardless of whether the exterior free edge 54 is curved or straight.

The concave edge provided along the exterior free edge 54 is particularly advantageous in assisting the user in identifying the location of the entry opening 50 and facilitating entry into the garment near the center of the entry opening 50. Additionally, the length of the entry opening 50, which extends horizontally from one side to another of the garment, facilitates donning of the garment. While the entry opening extends across a substantial portion of the back of the torso, a significant degree of stretch is still required for the wearer to pass the garment over their shoulder blades and hips, and the four-way stretch capabilities of the fabric facilitates this stretching. Additionally, the vertical placement of the entry opening 50 along the bottom of the shoulder blades of the wearer 90 has been determined to further facilitate donning of the garment by reducing the effort required to insert the legs and arms of the wearer into the garment. The four-way stretch capabilities of the garment also facilitates stretching the collar over the head of the wearer.

Once donned, the bodysuit 10 is configured to completely cover the torso, arms and legs of the wearer (but not the head, hands and feet). With the entry opening free of mechanical fasteners, the one-piece bodysuit offers a consistent fit around the entire body of the wearer with a full 360° of stretch and comfort that is not interrupted by mechanical fasteners that limit stretch. The disclosed arrangement also provides another benefit in that the garment may be easily recycled because it is free of mechanical fasteners that traditionally contain metal or other components that would otherwise make the garment difficult to recycle.

Exemplary Embodiment with Open Passage for Entry Opening

Figure 5:
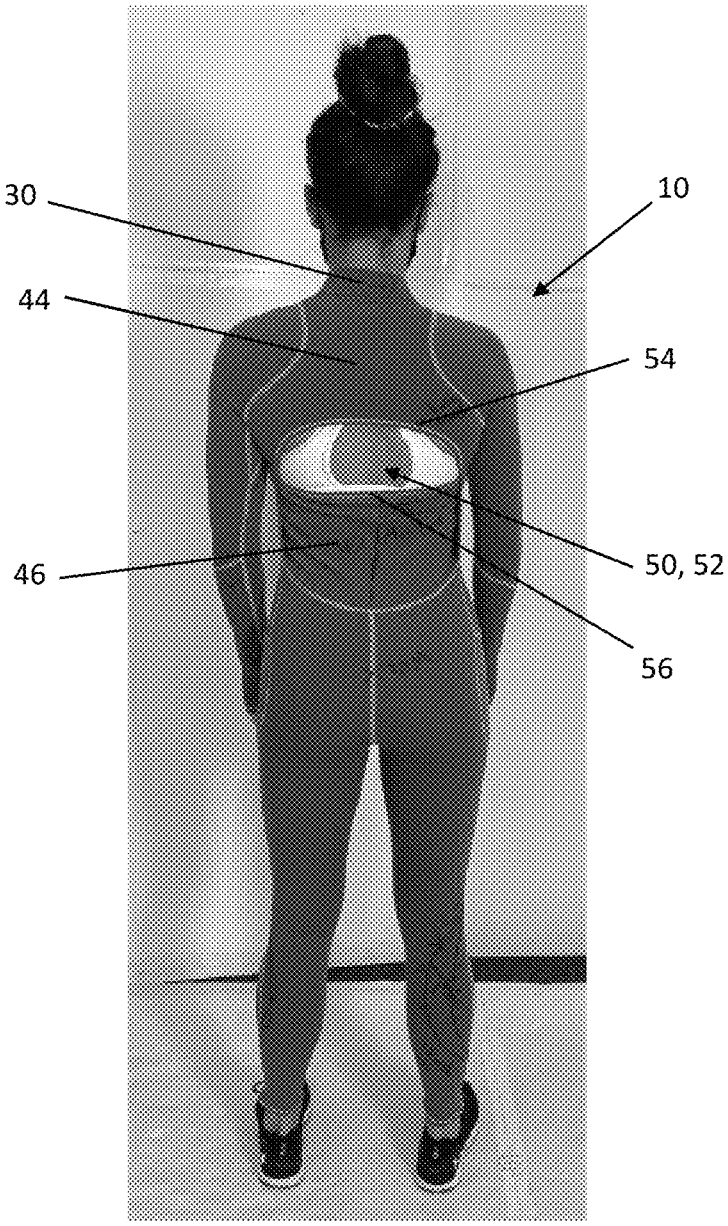
FIG. 5 shows a back view of an alternative embodiment of the bodysuit of FIG. 1 worn by a human, the bodysuit having an entry opening that remains open when worn.

With reference now to FIG. 5, in at least one embodiment of the bodysuit 10, the entry opening 50 is provided by an open passage 52 wherein the interior of the bodysuit 10 is exposed without the need to separate two free edges of the fabric panels on the back 28 of the torso 20. This embodiment of the bodysuit 10 is similar to that described above in association with FIGS. 1-4. However, in the embodiment of FIG. 5, the body of the wearer is exposed via the open passage 52 of the entry opening 50 when the wearer dons the bodysuit 10. The open passage 52 may be configured in any of a number of different sizes and shapes. In the embodiment of FIG. 5, the open passage has an oval-like shape defined by a concave free edge 54 on an upper panel of the back 28 and a concave or relatively straight free edge 56 on a lower panel of the back. As shown in FIG. 5, the back of the wearer is exposed through the entry opening 50 during wear.

This open passage configuration of the entry opening 50 is particularly useful for applications wherein additional cooling of the user is desired during use.

Exemplary Embodiment with Straight Free Edges of Entry Opening

Figure 6:
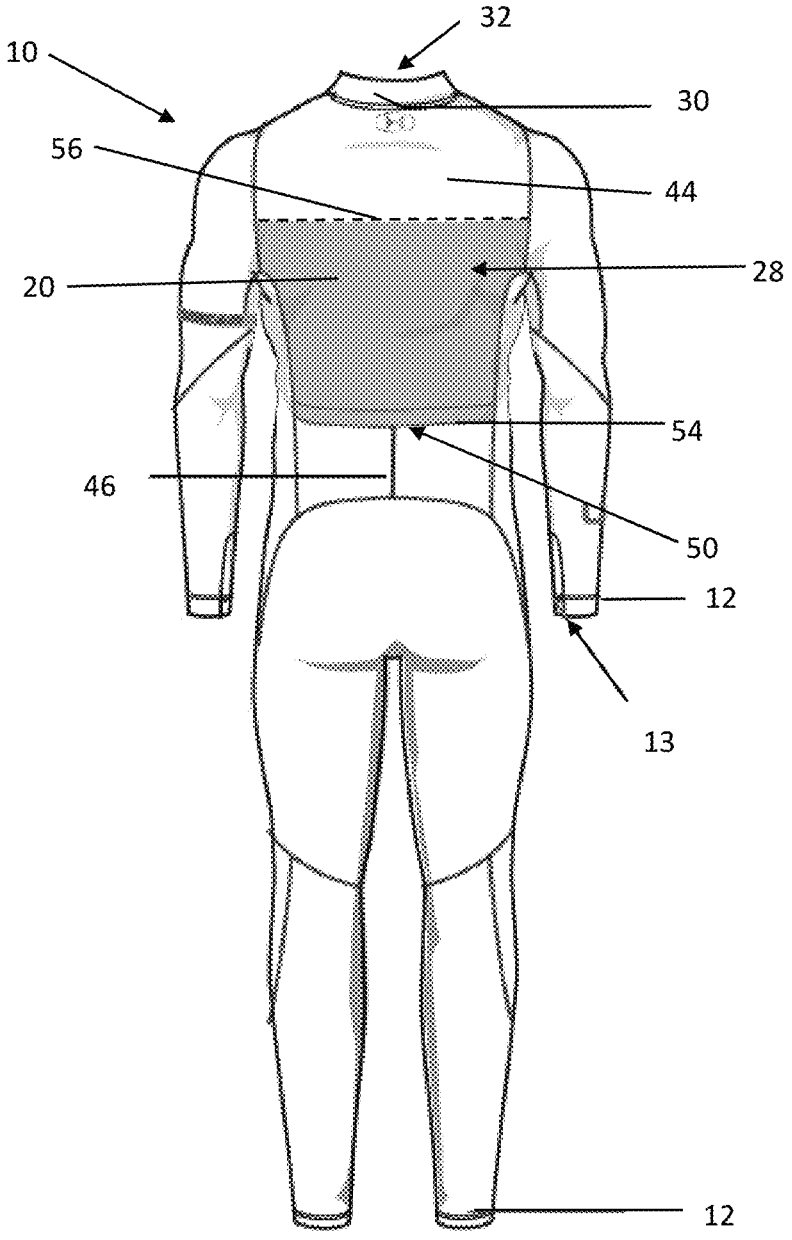
FIG. 6 shows another alternative embodiment of the bodysuit of FIG. 1, the entry opening defined along a straight edge of an outer panel.
Figure 7:
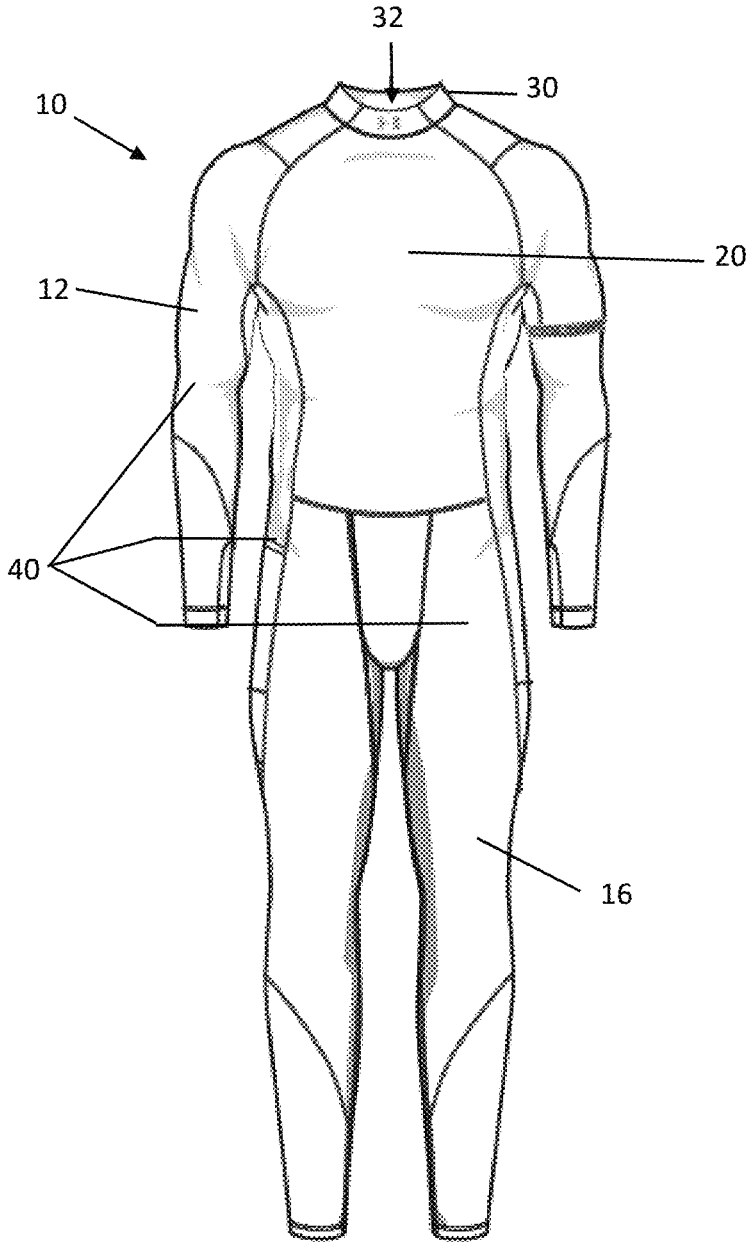
FIG. 7 shows a front view of the bodysuit of FIG. 6.

With reference now to FIGS. 6 and 7, in at least one embodiment of the bodysuit 10, the exterior free edge 54 and interior free edge 56 of the entry opening 50 are straight edges that do not have a concave or convex curvature. This embodiment of the bodysuit 10 is similar to that described above in association with FIGS. 1-4. However, in the embodiment of FIGS. 6 and 7, both edges 54 and 56 extend horizontally and substantially straight across the back 28 of the torso 20. The interior free edge 56 is configured to extend horizontally across the shoulder blades of the wearer in the thoracic region 22 of the torso 20. The exterior free edge 54 is parallel to the interior free edge 56 and is arranged 8 to 18 inches below the interior free edge 56. The shaded region in FIG. 6 shows the overlap between the upper back panel 44 and the lower back panel 46. While this extent of overlap requires the wearer to stretch the entry opening 50 to a greater degree in order to don the garment, the overlap ensures that the entry opening 50 remains closed at all time during wear. Accordingly, this closed passage configuration of the entry opening 50 is particularly useful in applications wherein continuous skin coverage and insulation of the complete torso of the wearer is desired during use.

Exemplary Embodiment with Shorts and Short Sleeves

Figure 8:
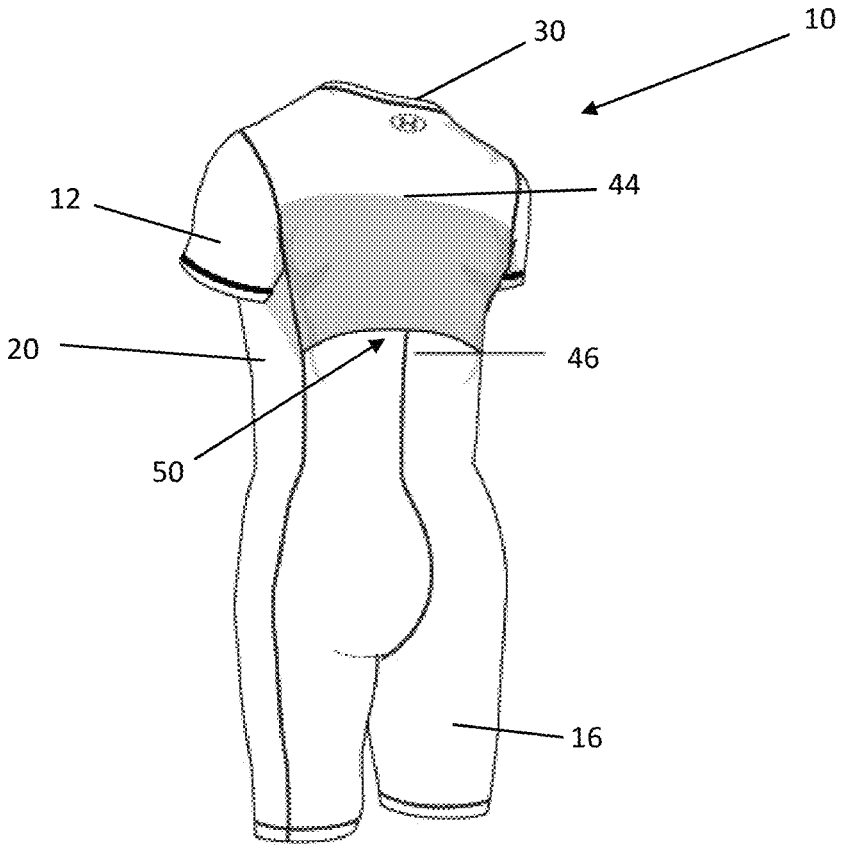
FIG. 8 shows a back view of yet another alternative embodiment of the bodysuit of FIG. 1 wherein the bodysuit includes short sleeves and truncated legs.
Figure 9:
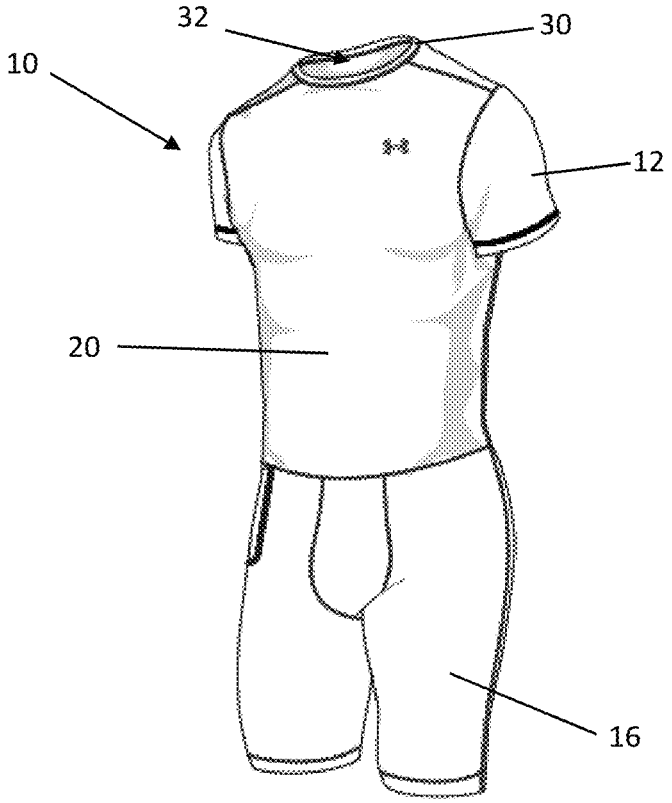
FIG. 9 shows a front view of the bodysuit of FIG. 8.

With reference now to FIGS. 8 and 9, in at least one embodiment of the bodysuit 10, the limb portions of the bodysuit are shortened. This embodiment of the bodysuit 10 is similar to that described above in association with FIGS. 1-4, but in the embodiment of FIGS. 8 and 9, the arms 12 are provided by short sleeves (rather than long sleeves as shown in FIGS. 1-4), and the legs 16 are provided by short pant legs (rather than long pant legs as shown in FIGS. 1-4). This embodiment is particularly useful in applications wherein some cooling of the limbs is desired, but the legs and/or arms of the wearer will be exposed during use (e.g., typical bicycling applications).

Exemplary Embodiment without Legs and/or Sleeves

Figure 10:
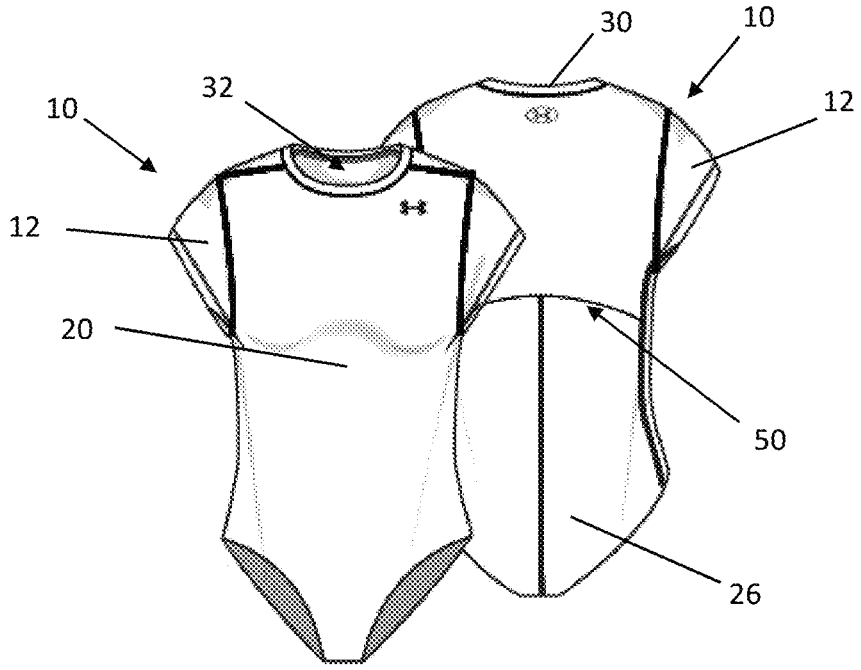
FIG. 10 shows a front and a rear view of another alternative embodiment of the bodysuit of FIG. 1, the bodysuit including short sleeves and no legs.

With reference now to FIG. 10, in at least one embodiment of the bodysuit 10, the limb portions of the bodysuit are substantially or completely removed. This embodiment of the bodysuit 10 is similar to that described above in association with FIGS. 1-4, but in this embodiment the arms 12 are provided by cap sleeves (or, alternatively, no sleeves). Additionally, in this embodiment, the pelvic region 26 of the torso is provided by a bikini bottom (i.e., there are no legs extending from the pelvic region 26). This embodiment is particularly useful in applications wherein significant cooling of the limbs is desired, and the legs and/or arms of the wearer will be exposed during use (e.g., typical gymnastic or swimming applications).

Exemplary Embodiment with Padding

Figure 11:
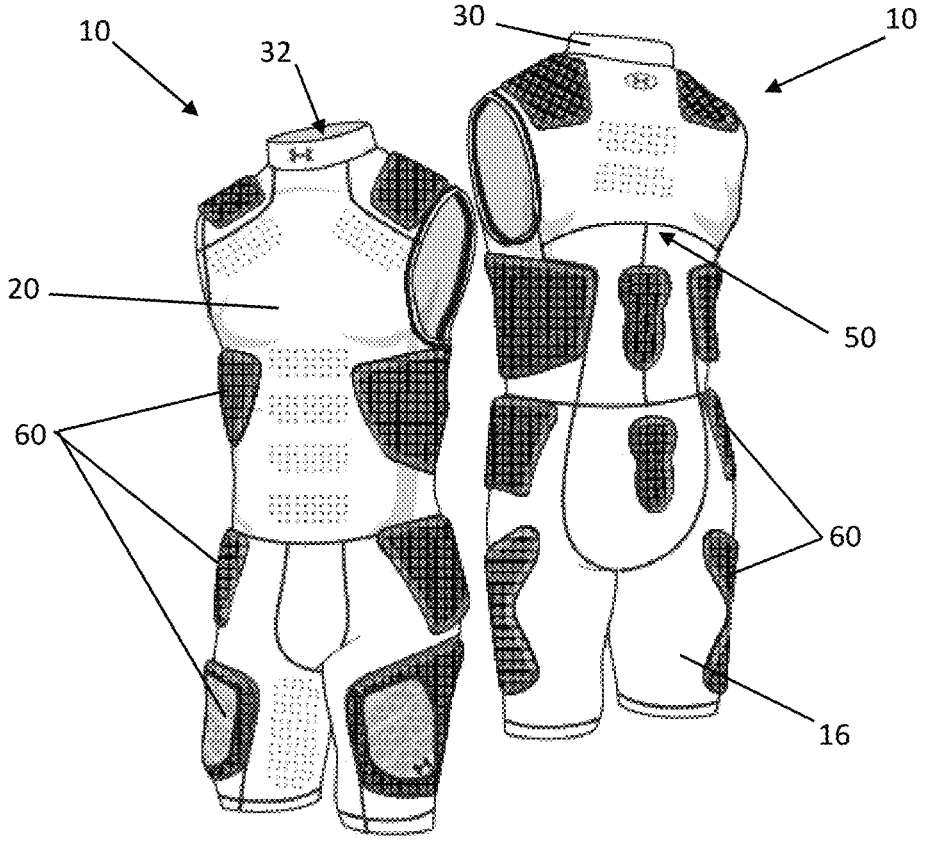
FIG. 11 shows a front view and rear view of yet another alternative embodiment of the bodysuit of FIG. 1, the bodysuit including pads positioned thereon.

With reference now to FIG. 11, in at least one embodiment of the bodysuit 10, the limb portions of the bodysuit are shortened (similar to that shown in FIGS. 8 and 9), and the bodysuit also includes pads 60 that are permanently affixed to the bodysuit. The pads 60 may be any number of different types of pads designed and dimensioned to protect different areas of the body, such as shoulder pads, rib pads, hip pads, thigh pads, etc., as will be recognized by those of skill in the art. This embodiment is particularly useful in contact sport applications, such as football, wherein both protective padding as well as the mobility of the wearer is of upmost importance.

Method of Donning a One-Piece Bodysuit

Figure 12:
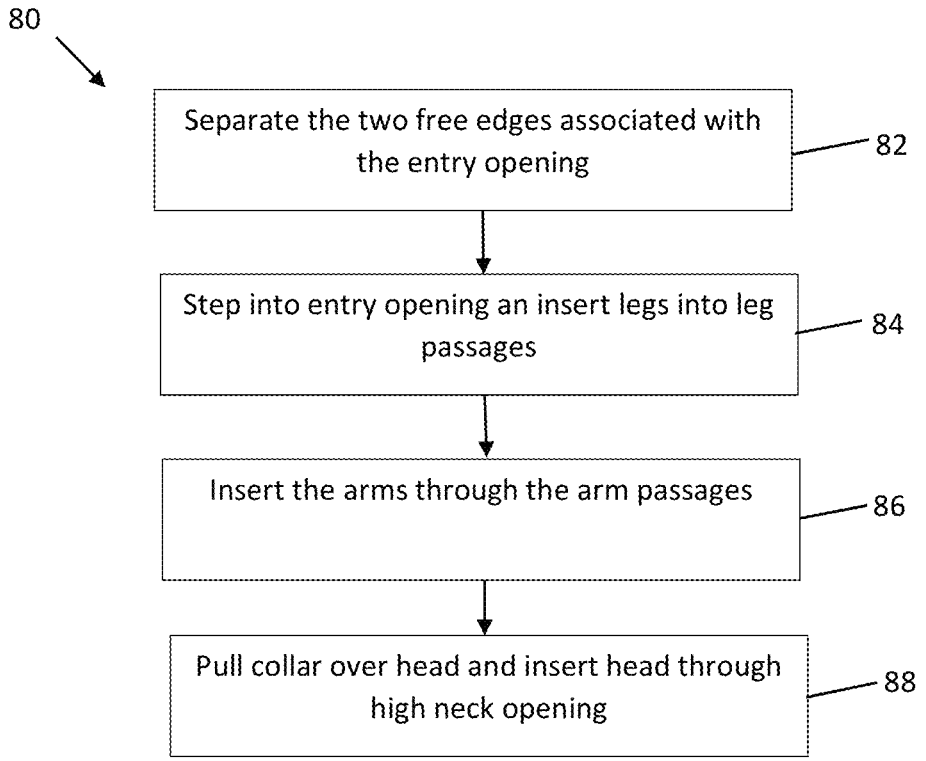
FIG. 12 is a flowchart of a method of donning the bodysuit of FIG. 1.

With reference now to FIG. 12, a unique method 80 of donning a bodysuit 10 is disclosed. As noted at block 82, the method includes first separating two free edges associated with an entry opening 50 in the thoracic region 22 at the back of the torso 20. As noted at block 84, the method further includes the wearer stepping into the entry opening 50 and inserting their legs through the leg passages 17 and into the legs 16 of the bodysuit 10. Next, as noted at block 86, the method includes pulling the torso portion of the garment upward and inserting the wearer's arms through the arm passages 13 and into the arms 12 of the bodysuit 10. As noted at block 88, the collar of the bodysuit is then pulled over the head of the wearer, and the head is inserted through the high neck opening. With the head inserted through the high neck opening, the bodysuit 10 is then completely and easily donned without the need to connect any mechanical fasteners such as zippers, buttons, snaps, etc.

Although the various embodiments have been provided herein, it will be appreciated by those of skill in the art that other implementations and adaptations are possible. Furthermore, aspects of the various embodiments described herein may be combined or substituted with aspects from other features to arrive at different embodiments from those described herein. Thus, it will be appreciated that various of the above-disclosed and other features and functions, or alternatives thereof, may be combined into many different embodiments and applications. Various presently unforeseen or unanticipated alternatives, modifications, variations, or improvements therein may be subsequently made by those skilled in the art which are also intended to be encompassed by the following claims.

What is claimed is:

1. A one-piece body suit comprising:

a collar with a collar perimeter defining a high neck opening, wherein the entire collar perimeter is configured to be positioned above the sternum and clavicle of a wearer when the one-piece body suit is worn; and a torso comprised of a four-way stretch fabric, the torso including:

a thoracic region connected to the collar and defining arm passages;

an abdominal region connected to the thoracic region;

a pelvic region connected to the abdominal region and defining leg passages; and an entry opening for the one-piece body suit positioned in a back of the torso, wherein the entry opening is free of releasable mechanical fasteners, wherein the entry opening is positioned in the thoracic region, elongated in a horizontal direction from a left side to a right side of the torso, and is configured to extend across shoulder blades of a wearer when the one-piece body suit is worn.

2. The one-piece body suit of claim 1 further comprising at least one limb connected to at least one of the thoracic region and the pelvic region, the at least one limb comprised of the four-way stretch fabric.

3. The one-piece body suit of claim 1 wherein the entry opening is defined between overlapping panels of the four-way stretch fabric such that the entry opening is a closed passage, the overlapping panels including a first panel defining an outer edge and a second panel defining an inner edge.

4. The one-piece body suit of claim 3 wherein the outer edge is a concave edge on the first panel.

5. The one-piece body suit of claim 3 wherein the first panel overlaps the second panel by at least two inches.

6. The one-piece body suit of claim 1 wherein the entry opening is defined by a hole formed in the back of the torso such that the entry opening is an open passage.

7. The one-piece body suit of claim 1 further comprising stitching that connects a plurality of panels of the four-way stretch fabric, wherein each of the plurality of panels extends between two or more of the thoracic region, the abdominal region, and the pelvic region.

8. A garment comprising:

a torso comprised of a four-way stretch fabric, the torso designed and dimensioned to completely cover a torso of an adult human;

a collar connected to the torso and defining a high neck opening centrally positioned on the garment above the torso, wherein an entire perimeter of the collar is configured to be positioned above the sternum and clavicle of the wearer when the garment is worn;

an entry opening positioned at a back of the torso, the entry opening defined between free edges of overlapping panels of the four-way stretch fabric;

two arms extending from an upper side the torso; and two legs extending from a lower side of the torso;

wherein the torso, two arms, and two legs form a one-piece body suit, the entry opening configured for doffing and donning the body suit and configured to extend across shoulder blades of a wearer when the garment is worn.

9. The garment of claim 8, wherein the entry opening is elongated in a horizontal direction from a left side to a right side of the torso.

10. The garment of claim 9, wherein the overlapping panels define an interior free edge and an exterior free edge.

11. The garment of claim 10, wherein the exterior free edge is a concave edge.

12. The garment of claim 10, wherein the exterior free edge is a straight edge.

13. The garment of claim 8 wherein the two legs are short pants and the two arms are short sleeves.

14. The garment of claim 8 wherein the two legs are long pants and the two arms are long sleeves.

15. A garment comprising:

a plurality of fabric panels connected by stitching and forming a one-piece body suit, each of the plurality fabric panels provided by a four-way stretch fabric;

a high neck opening formed at a top of the one-piece body suit, wherein an entirety of the high neck opening is configured to be positioned above the sternum and clavicle of the wearer when the garment is worn; and an entry opening positioned at a back of the one-piece body suit in a thoracic region of the bodysuit below the high neck opening, the entry opening free of releasable mechanical fasteners, wherein the entry opening is configured to extend across shoulder blades of a wearer when the garment is worn.

16. The garment of claim 15 wherein the entry opening is designed and dimensioned to receive a body of an adult human and to allow the human to don the one-piece body suit.

17. The garment of claim 16 wherein the entry opening is defined between overlapping free edges provided by two of the plurality of fabric panels.

* * * * *